US008861772B2

(12) United States Patent
Huang et al.

(10) Patent No.: US 8,861,772 B2
(45) Date of Patent: Oct. 14, 2014

(54) EARPHONE RECEIVING ASSEMBLY AND PORTABLE ELECTRONIC DEVICE HAVING SAME

(71) Applicants: Shenzhen Futaihong Precision Industry Co., Ltd., Shenzhen (CN); FIH (Hong Kong) Limited, Kowloon (HK)

(72) Inventors: Lei Huang, Shenzhen (CN); Xiao-Liang Wei, Shenzhen (CN)

(73) Assignee: Scienbizip Consulting (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 13/690,296

(22) Filed: Nov. 30, 2012

(65) Prior Publication Data

US 2013/0287240 A1 Oct. 31, 2013

(30) Foreign Application Priority Data

Apr. 28, 2012 (CN) ..... 201210130287.0

(51) Int. Cl.
*H04R 1/10* (2006.01)

(52) U.S. Cl.
CPC ..... *H04R 1/10* (2013.01); *H04R 1/1033* (2013.01); *H04R 1/1016* (2013.01)
USPC ..... 381/384; 381/380; 381/386; 361/679.01

(58) Field of Classification Search
CPC . H04R 1/1033; H05K 5/0221; H05K 5/0226; G06F 1/1656
USPC ..... 381/322, 384, 386, 380; 361/679.01; 220/811, 827
See application file for complete search history.

(56) References Cited

U.S. PATENT DOCUMENTS

| | | | | |
|---|---|---|---|---|
| 5,060,990 | A * | 10/1991 | Smith et al. | 292/91 |
| 5,206,098 | A * | 4/1993 | Cho et al. | 429/96 |
| 5,931,513 | A * | 8/1999 | Conti | 292/87 |
| 6,409,042 | B1 * | 6/2002 | Hirano et al. | 220/812 |
| 6,929,878 | B2 * | 8/2005 | Chen et al. | 429/100 |
| 7,068,495 | B2 * | 6/2006 | Luo et al. | 361/679.56 |
| 7,261,973 | B2 * | 8/2007 | Tu et al. | 429/100 |
| 7,488,554 | B2 * | 2/2009 | Wang et al. | 429/100 |
| 7,488,555 | B2 * | 2/2009 | Chen et al. | 429/100 |
| 7,867,646 | B2 * | 1/2011 | Rhodes | 429/100 |
| 8,243,441 | B2 * | 8/2012 | Xu | 361/679.56 |
| 8,252,454 | B2 * | 8/2012 | Jiang | 429/163 |
| 8,567,637 | B2 * | 10/2013 | Mori et al. | 220/827 |
| 2010/0210324 | A1 * | 8/2010 | Xu | 455/575.1 |
| 2010/0320221 | A1 * | 12/2010 | Chang | 220/810 |
| 2011/0233078 | A1 * | 9/2011 | Monaco et al. | 206/223 |
| 2012/0128193 | A1 * | 5/2012 | Stevinson | 381/384 |
| 2012/0145570 | A1 * | 6/2012 | Monaco et al. | 206/216 |

(Continued)

*Primary Examiner* — Curtis Kuntz
*Assistant Examiner* — Joshua A Kaufman
(74) *Attorney, Agent, or Firm* — Novak Druce Connolly Bove + Quigg LLP

(57) ABSTRACT

An earphone receiving assembly for receiving an earphone includes a main body surrounding an accommodating space for receiving the earphone and defining an opening communicating with the accommodating space, a cover releasably locked in the opening, and a releasing assembly. The releasing assembly includes a fastening member secured to the main body and a rotating member rotatably assembled to the fastening member. The cover is slidably assembled to the rotating member. When the cover is released from being locked within the opening, the rotating member rotates and lifts the cover from the opening to expose the earphone.

19 Claims, 6 Drawing Sheets

(56) References Cited

U.S. PATENT DOCUMENTS

2013/0148839 A1* 6/2013 Stevinson ..... 381/384
2013/0238829 A1* 9/2013 Laycock et al. ..... 710/303
2014/0001942 A1* 1/2014 Mao et al. ..... 312/333

* cited by examiner

EARPHONE RECEIVING ASSEMBLY AND PORTABLE ELECTRONIC DEVICE HAVING SAME

BACKGROUND

1. Technical Field

The present disclosure relates to earphone receiving assemblies and portable electronic devices employing the earphone receiving assemblies.

2. Description of Related Art

Usually, earphones are used to listen to music stored in portable electronic devices (e.g., MP3 players). However, the earphones are typically separated from the electronic devices when not used, causing inconvenience in carrying. In addition, when the earphones are detached from the electronic device, the earphones may be easily lost or misplaced.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
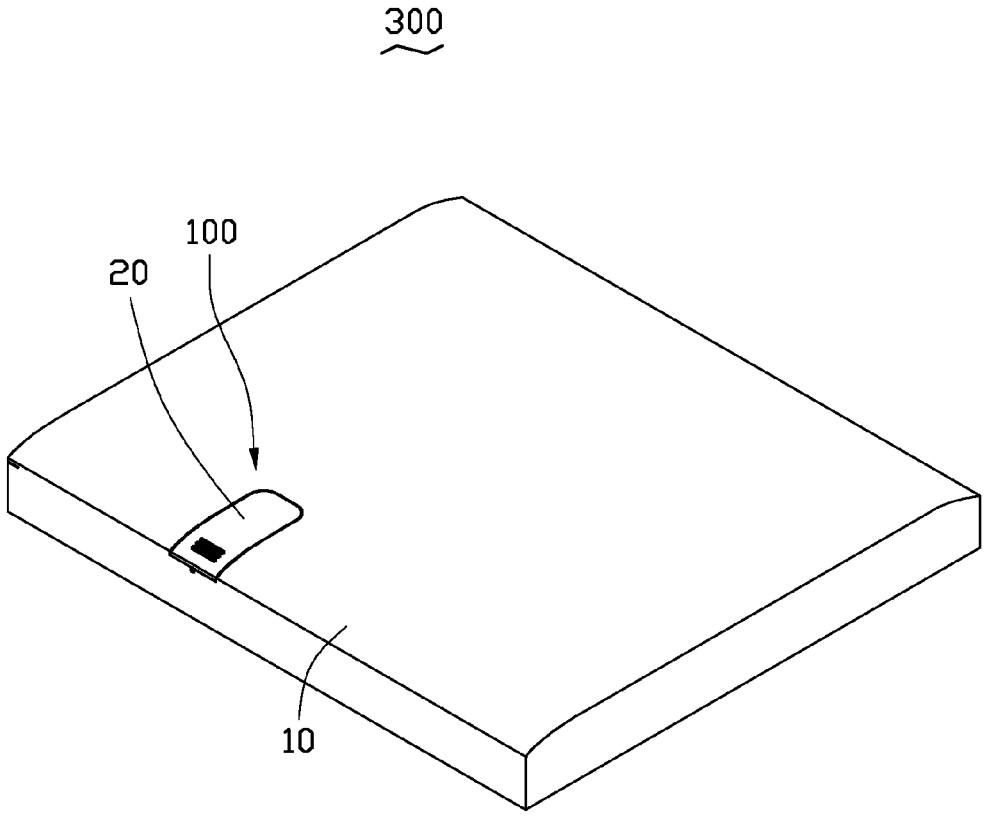
FIG. 1 is an isometric view of a portable electronic device employing an earphone receiving assembly in accordance with an exemplary embodiment.
Figure 2:
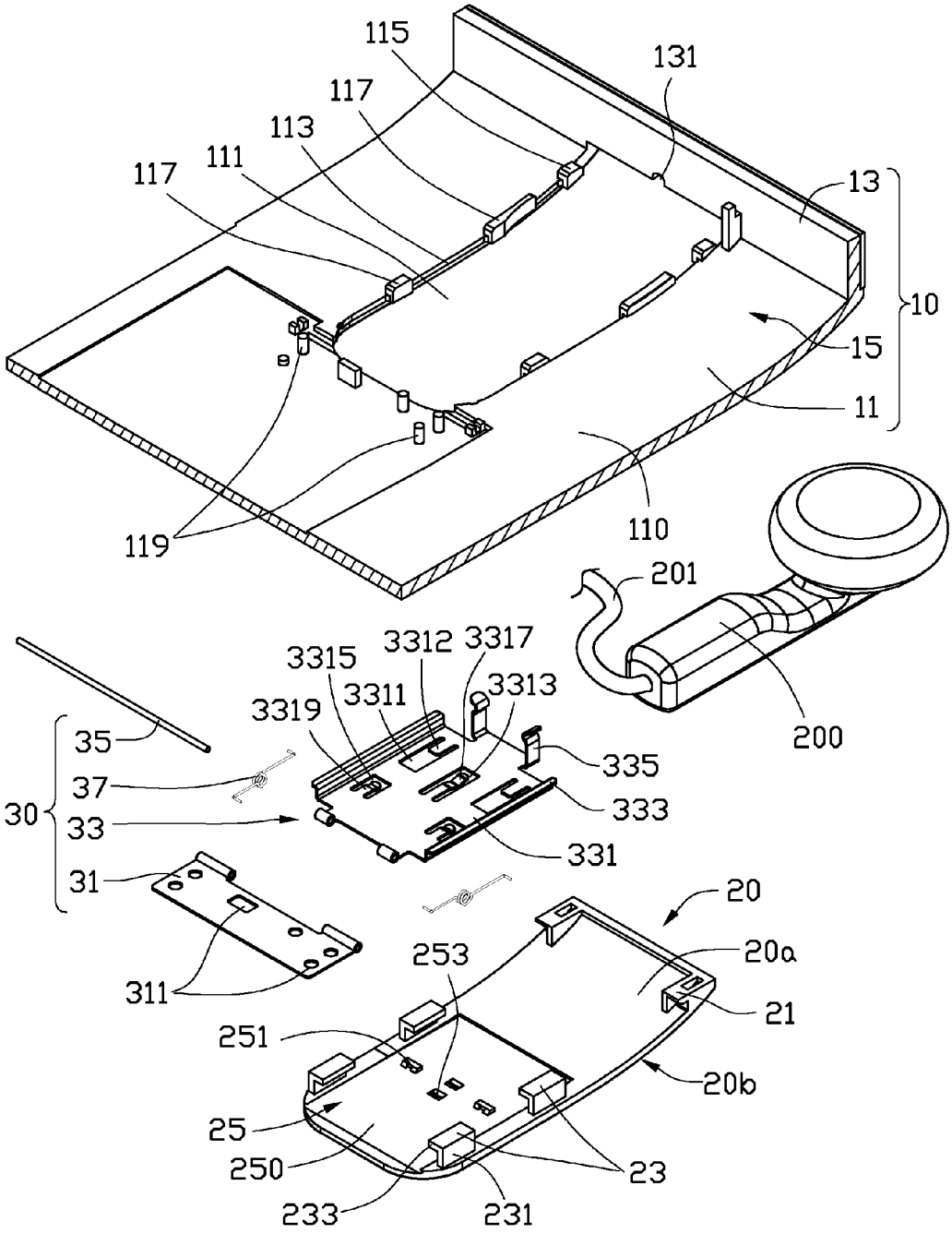
FIG. 2 is an exploded view of the earphone receiving assembly of FIG. 1 viewed from a first angle.

FIG. 1 and FIG. 2 show an exemplary embodiment of a portable electronic device 300 employing an earphone receiving assembly 100 for receiving an earphone 200. The portable electronic device 300 may be a mobile phone or a MP3 player, for example. The earphone receiving assembly 100 includes a main body 10, a cover 20 and a releasing assembly 30.

Figure 3:
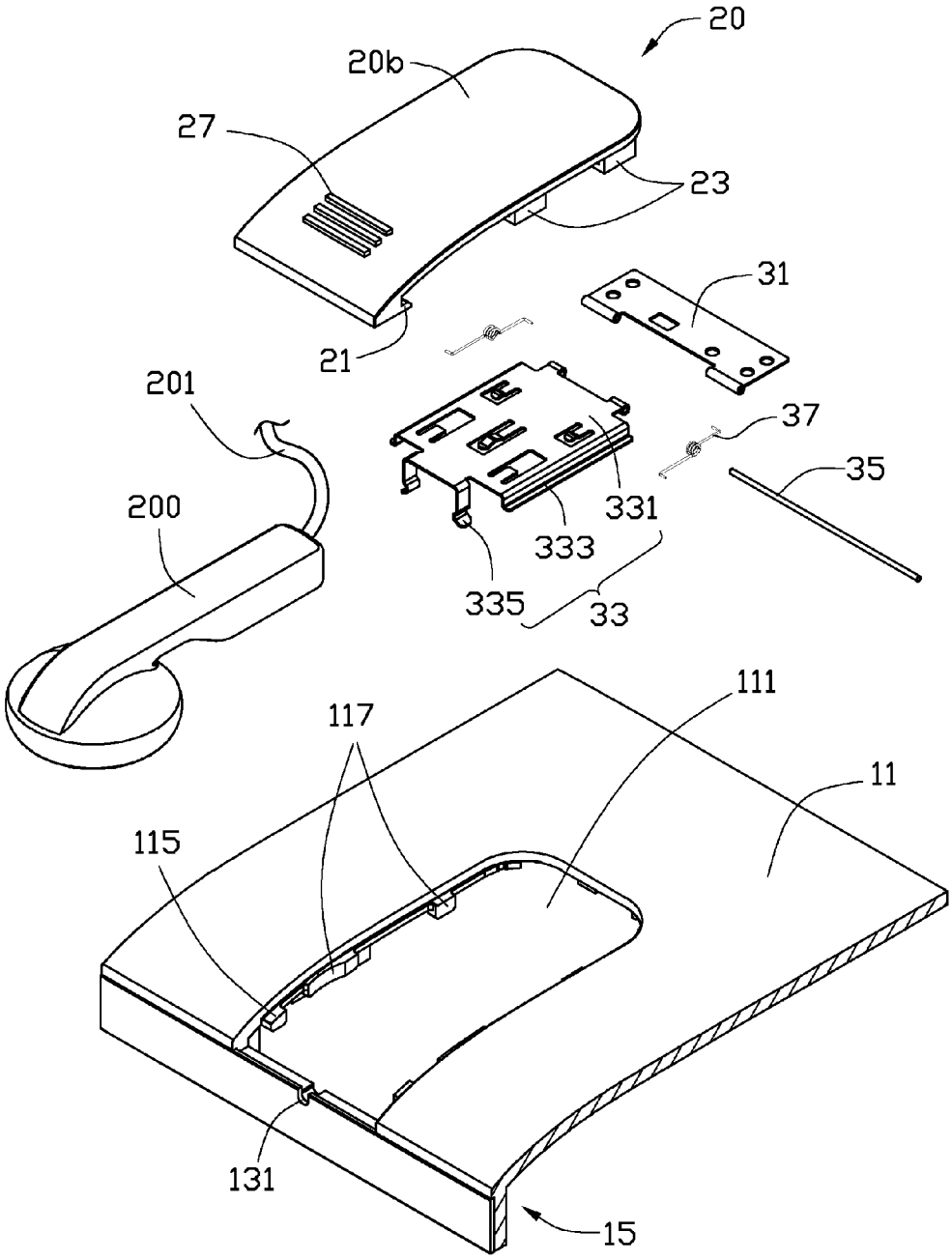
FIG. 3 is an exploded view of the earphone receiving assembly of FIG. 1 viewed from a second angle.
Figure 4:
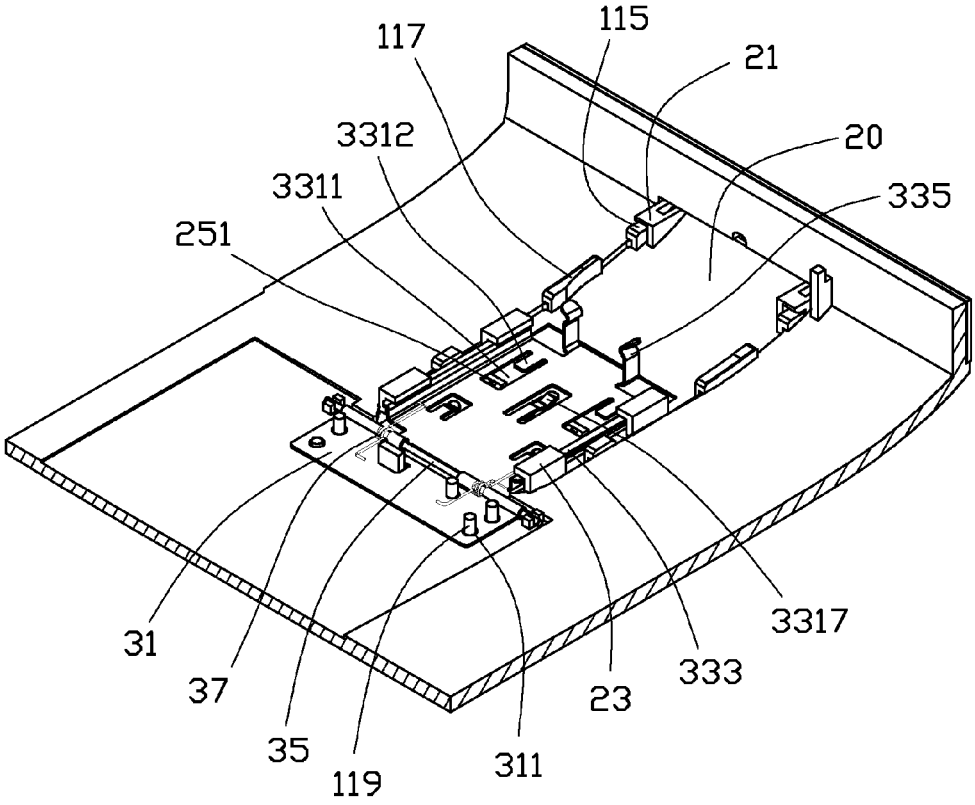
FIG. 4 is an isometric view of the earphone receiving assembly of FIG. 1 viewed from another angle.

FIG. 2-FIG. 4 show that the main body 10 may be a housing member of the portable electronic device 300. The main body 10 includes a bottom wall 11, a peripheral wall 13 protruding from a peripheral edge of the bottom wall 11 and extending towards an inner surface 110 of the bottom wall 11, and an accommodating space 15 surrounded by the bottom wall 11 and the peripheral wall 13.

The bottom wall 11 defines an opening 111 at a position adjacent to the peripheral wall 13. The opening 111 communicates with the accommodating space 15 and is used for receiving the cover 20. The opening 111 includes two opposite side walls 113. Each side wall 113 has a latching block 115 and at least one first limiting block 117 separately protruding from a portion near the inner surface 110. The latching blocks 115 and the first limiting blocks 117 all protrude into the opening 111. The latching blocks 115 of the two side walls 113 are opposite to each other. When the cover 20 is mounted in the opening 111, the latching blocks 115 latch the cover 20, and the first limiting blocks 117 are located beneath the cover 20 and support the cover 20, to prevent the cover 20 from falling into the accommodating space 15 under a downward pressure. Furthermore, when the cover 20 slides in the opening 111 to be released from latching with the latching blocks 115, the first limiting blocks 117 guides the cover 20 to slide. In the exemplary embodiment, the each side wall 113 has two first limiting blocks 117. The accommodating space 15 is used for receiving the earphone 200 (see FIG. 5). The peripheral wall 13 defines a notch 131 communicating with the opening 111. When the earphone 200 is taken out from the accommodating space 15, connecting cable 201 of the earphone 200 may extend out of the main body 10 through the notch 131.

The cover 20 is releasably locked in the opening 111 and can be opened under the force of the releasing assembly 30. The cover 20 includes an interior surface **20*a* and an exterior surface 20*b* on an opposite side to the interior surface 20*a*. When the cover 20 is mounted in the opening 111, the interior surface 20*a* faces the accommodating space 15. The interior surface 20*a* has two clasps 21 separately protruding from an end portion. Each clasp 21 releasably clasps one of the latching blocks 115, thereby securing the cover 20 in the opening 111 (see FIG. 4). When the cover 20 slides along the side walls 113 towards the peripheral wall 13 under an outside force, the cover 20 detaches from the latching blocks 115, releasing the lock between the clasps 21 and the latching blocks 115. The interior surface 20*a* further has a plurality of guiding blocks 23 separately protruding from a peripheral edge. When the cover 20 is mounted in the opening 111, the guiding blocks 23 and the first limiting blocks 117 are alternately arranged as shown in FIG. 4. Each guiding block 23 is substantially L-shaped which has a connecting portion 231, protruding perpendicularly from the interior surface 20*a*, and a guiding portion 233, extending perpendicularly from the connecting portion 231. When the cover 20 slides in the opening 111, the guiding portions 233 of the guiding blocks 23 abuts against the releasing assembly 30 to guide the cover 20**.

The interior surface **20*a* defines a sliding recess 25 in another end portion away from the clasps 21. The bottom 250 of the sliding recess 25 has at least one second limiting block 251, protruding therefrom, and defines at least one positioning recess 253. In the exemplary embodiment, the bottom 250 defines two second limiting blocks 251 and two positioning recesses 253. The two positioning recesses 253 are located between the two second limiting blocks 251. The two positioning recesses 253 are separately arranged in a line parallel to the sliding direction of the cover 20. The exterior surface 20*b* has a plurality of protruding trips 27 (shown in FIG. 3) separately protruding therefrom, for users to be able to push the cover 20**.

The releasing assembly 30 comprises a fastening member 31, a rotating member 33, a shaft 35, and two torsion springs 37. The fastening member 31 is secured to the inner surface 110 of the bottom wall 11. In the exemplary embodiment, the fastening member 31 is secured to the inner surface 110 by hot-melt. In this embodiment, the fastening member 31 defines hot-melt holes 311. The inner surface 110 has hot-melt poles 119 protruding therefrom corresponding to the hot-melt holes 311. When the fastening member 31 is secured to the main body 10, the hot-melt poles 119 extend through hot-melt holes 311, respectively. The fastening member 31 is attached to the main body 10 by heating the hot-melt poles 119 to enable the hot-melt poles 119 to melt and bond the fastening member 31.

The rotating member 33 is rotatably assembled to the fastening member 31 through the shaft 35 and the torsion spring 37. The rotating member 33 comprises a base portion 331 and two sliding portions 333. The two sliding portions 333 extend perpendicularly from two opposite edge portions of the base portion 331, respectively, and then bend towards a direction parallel to the base portion 331. The base portion 331 is slidably received in the sliding recess 25. Each sliding portion 333 slidably abuts against the guiding portions 233 of the corresponding guiding blocks 23, thereby slidably assembling the rotating member 33 to the cover 20. As such, when the rotating member 33 rotates relative to the fastening member 31, the cover 20 rotates relative to the main body 10, thus allowing the earphone 200 to be exposed for use.

The base portion 331 defines at least one limiting hole 3311 corresponding to the at least one second limiting block 251. In the exemplary embodiment, the base portion 331 has two limiting holes 3311, and each limiting hole 3311 receives one second limiting block 251. Each limiting hole 3311 extends along the sliding portion 333 to be substantially rectangular. During the reciprocation of the cover 20 relative to the rotating member 33, each of the second limiting blocks 251 alternatively resist against two ends of the limiting hole 3311 wherein the second limiting block 251 is received, thereby limiting the sliding route of the cover 20. In the exemplary embodiment, each limiting hole 3311 further has a resisting sheet 3312 protruding from one end and extending into the limiting hole 3311. The resisting sheets 3312 resists against the second limiting blocks 251 during the reciprocation of the cover 20.

The base portion 331 further defines a first hole 3313 and two second holes 3315. The first hole 3313 has a first flexible sheet 3317 protruding from one end and extending into the first hole 3313. The free end of the first flexible sheet 3317 has a bent portion (not labeled) flexibly resisting against the bottom 250 of the sliding recess 25. The first flexible sheet 3317 slides alternatively into the two positioning recesses 253, during the reciprocation of the cover 20 to position the cover 20. Each second hole 3315 has a second flexible sheet 3319 protruding from one end and extending into the second hole 3315. Each second flexible sheet 3319 flexibly resists against the bottom 250 to assist positioning the cover 20.

Figure 5:
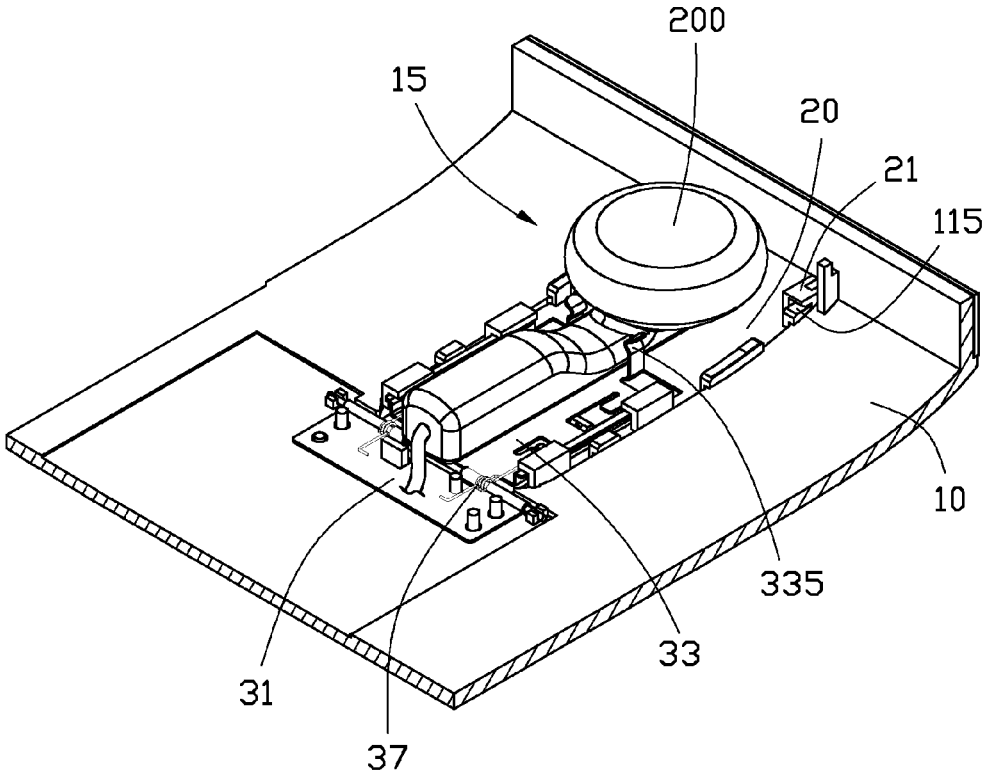
FIG. 5 is an isometric view showing the earphone receiving assembly of FIG. 1 incorporating an earphone in a first state.
Figure 6:
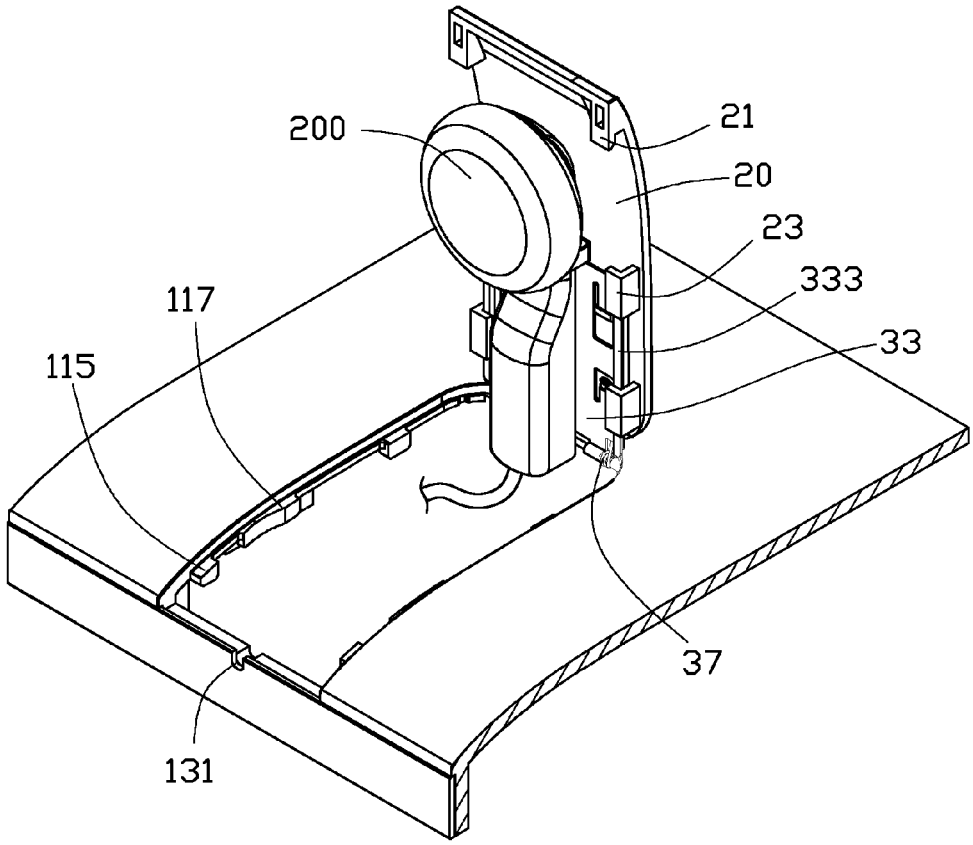
FIG. 6 is an isometric view showing the earphone receiving assembly of FIG. 1 incorporating an earphone in a second state.

The base portion 331 has two catching arms 335 protruding from an end away from the fastening member 31 and extending towards the accommodating space 15. The two catching arms 335 are positioned opposite to each other and are used for detachably holding the earphone 200. FIG. 5 shows that when the cover 20 is mounted in the opening 111, the earphone 200 is held by the catching arms 335, fastening to the rotating member 33, and is received in the accommodating space 15. FIG. 6 shows that when the cover 20 is open relative to the main body 10 under the force of the rotating member 33, the earphone 200 is detached from the accommodating space 15.

The fastening member 31 and the rotating member 33 are assembled together through shaft 35. The torsion springs 37 are coiled around the shaft 35. Each torsion spring 37 has an end flexibly abutting against the rotating member 33 and another end flexibly resisting against the fastening member 31. When the clasps 21 of the cover 20 clasp the latching blocks 115 of the main body 10, the torsion springs 37 accumulates elastic force. When the lock between the clasps 21 and the latching blocks 115 is released, the elastic force of the torsion springs 37 drives the rotating member 33 to rotate relative to the fastening member 31, thus driving the cover 20 to rotate relative to the main body 10 exposing the earphone 200.

To assemble the earphone receiving assembly 100, the fastening member 31 is secured to the inner surface 110 of the bottom wall 11 by hot-melting the hot-melt poles 119 in the hot-melt holes 311. To assemble the rotating member 33 to the cover 20, the rotating member 33 is inserted within the sliding recess 25 of the cover 20 with each sliding portion 333 slidably abutting against the corresponding guiding blocks 23. Then, the cover 20 is received in the opening 111 and is pushed towards the fastening member 31, to enable the clasps 21 to clasp the latching blocks 115. The torsion springs 37 are rotatably coiled around the shaft 35, and then the rotating member 33 is assembled to the fastening member 31 through the shaft 35 with each torsion spring 37 having an end flexibly resisting against the rotating member 33 and another end flexibly resisting against the fastening member 31. In this case, the torsion springs 37 accumulate elastic force.

When the earphone 200 is not used, the earphone 200 is caught by the two catching arms 335 and received in the accommodating space 15. To use the earphone 200, the cover 20 is pushed towards the direction away from the fastening member 31, to release the lock between the clasps 21 and the latching blocks 115. At this time, the first flexible sheet 3317 of the rotating member 33 slides from one positioning recess 253 into another positioning recess 253. Then, the rotating member 33 rotates under the elastic force of the torsion springs 37 and lifts the cover 20 from the opening 111, thus exposing the earphone 200 to users. When the earphone 200 is taken out, the cover 20 is pushed towards the opening 111 until being received in the opening 111, and then it is pushed towards the fastening member 31 until the clasps 21 are clasping the latching blocks 115, thus closing the cover 20 on the main body 10.

The clasps 21 can also be formed on the main body 10. In this case, the latching blocks 115 are formed on the cover 20.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An earphone receiving assembly for receiving an earphone, comprising:

a main body surrounding an accommodating space for receiving the earphone and defining an opening communicating with the accommodating space, the opening having at least one first limiting block protruding therefrom;

a cover releasably and slidably locked in the opening, the cover having an interior surface, the interior surface having at least one second limiting block protruding therefrom; and a releasing assembly, the releasing assembly comprising:

a fastening member secured to the main body; and a rotating member rotatably assembled to the fastening member, and the cover is slidably assembled to the rotating member, the rotating member comprising a base portion, the base portion defining at least one limiting hole, each limiting hole having a resisting sheet protruding from one end and extending into the limiting hole, during the reciprocation of the cover relative to the rotating member, the at least one first limiting block contacting with the cover and guiding the cover to slide, and each second limiting block alternatively resisting against one end of the limiting hole and the resisting sheet;

wherein when the cover is released from being locked within the opening, the rotating member rotates and lifts the cover from the opening to expose the earphone.

2. The earphone receiving assembly as claimed in claim 1, wherein the rotating member has two catching arms, for detachably holding the earphone; and when the rotating member rotates and lifts the cover from the opening, the earphone is taken out from the accommodating space and exposed from the main body.

3. The earphone receiving assembly as claimed in claim 1, wherein the main body comprises a bottom wall and a peripheral wall, protruding from a peripheral edge of the bottom wall; the bottom wall and the peripheral wall cooperatively surround the accommodating space; and the opening is defined in the bottom wall.

4. The earphone receiving assembly as claimed in claim 3, wherein the opening comprises two opposite side walls; each of the side walls has a latching block protruding therefrom; the cover has two clasps; each of the clasps is configured to releasably clasp one of the latching blocks; and when the cover slides in the opening relative to the main body, the clasps clasp the latching blocks or release the latching blocks.

5. The earphone receiving assembly as claimed in claim 1, wherein when the cover is mounted in the opening, the at least one first limiting block is further located beneath the cover and supports the cover, to prevent the cover from falling into the accommodating space under a downward pressure.

6. The earphone receiving assembly as claimed in claim 3, wherein the peripheral wall defines a notch communicating with the opening; the earphone has a connecting cable; and the connecting cable extends out of the main body through the notch.

7. The earphone receiving assembly as claimed in claim 1, wherein the cover further comprises an exterior surface, opposite to the interior surface; the interior surface has a plurality of guiding blocks separately protruding from a peripheral edge; each of the guiding blocks has a connecting portion, protruding perpendicularly from the interior surface, and a guiding portion extending perpendicularly from the connecting portion; the rotating member further comprises two sliding portions extending from two opposite edge portions of the base portion, respectively; and each sliding portion slidably abuts against the guiding portions of the corresponding guiding blocks, thereby slidably assembling the rotating member to the cover.

8. The earphone receiving assembly as claimed in claim 7, wherein the two sliding portions extend perpendicularly from two opposite edge portions of the base portion, respectively, and then bend towards a direction parallel to the base portion.

9. The earphone receiving assembly as claimed in claim 1, wherein the interior surface further defines two positioning recesses; the base portion defines a first hole and at least one second hole; the first hole has a first flexible sheet protruding from one end and extending into the first hole; and the first flexible sheet flexibly resists against the interior surface and alternatively slides into the two positioning recesses during the reciprocation of the cover, each second hole having a second flexible sheet protruding from one end and extending into the second hole, each second flexible sheet flexibly resisting against a bottom of the base portion to assist positioning the cover.

10. The earphone receiving assembly as claimed in claim 1, wherein the releasing assembly further comprises a shaft and two torsion springs coiled around the shaft; the shaft assembles the fastening member and the rotating member together; and when the cover is locked within the opening, the torsion springs accumulate elastic force; when the cover is released from being locked within the opening, the elastic force of the torsion springs drives the rotating member rotating relative to the fastening member, thus driving the cover rotating relative to the main body to be detached from the opening.

11. A portable electronic device, comprising:

an earphone; and an earphone receiving assembly for receiving the earphone, the earphone receiving assembly comprising:

a main body surrounding an accommodating space for receiving the earphone and defining an opening communicating with the accommodating space, the opening having at least one first limiting block protruding therefrom;

a cover releasably and slidably locked in the opening, the cover having an interior surface, the interior surface having at least one second limiting block protruding therefrom; and a releasing assembly, the releasing assembly comprising a fastening member secured to the main body and a rotating member rotatably assembled to the fastening member, and the cover is slidably assembled to the rotating member, the rotating member comprising a base portion, the base portion defining at least one limiting hole, each limiting hole having a resisting sheet protruding from one end and extending into the limiting hole, during the reciprocation of the cover relative to the rotating member, the at least one first limiting block contacting with the cover and guiding the cover to slide, and each second limiting block alternatively resisting against one end of the limiting hole and the resisting sheet;

wherein when the cover is released from being locked within the opening, the rotating member rotates and lifts the cover from the opening to expose the earphone.

12. The portable electronic device as claimed in claim 11, wherein the rotating member has two catching arms, for detachably holding the earphone; and when the rotating member rotates and lifts the cover from the opening, the earphone is taken out from the accommodating space and exposed from the main body.

13. The earphone receiving assembly as claimed in claim 11, wherein the main body comprises a bottom wall and a peripheral wall protruding from a peripheral edge of the bottom wall; the bottom wall and the peripheral wall cooperatively surrounds the accommodating space; and the opening is defined in the bottom wall.

14. The earphone receiving assembly as claimed in claim 13, wherein the opening comprises two opposite side walls; each of the side walls has a latching block protruding therefrom; the cover has two clasps; each of the clasps is configured to releasably clasp one of the latching blocks; and when the cover slides in the opening relative to the main body, the clasps clasp the latching blocks or release the latching blocks.

15. The earphone receiving assembly as claimed in claim 11, wherein when the cover is mounted in the opening, the at least one first limiting block is further located beneath the cover and supports the cover, to prevent the cover from falling into the accommodating space under a downward pressure.

16. The earphone receiving assembly as claimed in claim 13, wherein the peripheral wall defines a notch communicating with the opening; the earphone has a connecting cable; and the connecting cable extends out of the main body through the notch.

17. The earphone receiving assembly as claimed in claim 11, wherein the cover further comprises an exterior surface, opposite to the interior surface; the interior surface has a plurality of guiding blocks separately protruding from a peripheral edge; each of the guiding blocks has a connecting portion, protruding perpendicularly from the interior surface, and a guiding portion extending perpendicularly from the connecting portion; the rotating member further comprises a two sliding portions, extending from two opposite edge portions of the base portion, respectively; and each sliding portion slidably abuts against the guiding portions of the corresponding guiding blocks, thereby slidably assembling the rotating member to the cover.

18. The earphone receiving assembly as claimed in claim 11, wherein the interior surface further defines two positioning recesses; the base portion defines a first hole and at least one second hole; the first hole has a first flexible sheet protruding from one end and extending into the first hole; and the first flexible sheet flexibly resists against the interior surface and alternatively slides into the two positioning recesses during the reciprocation of the cover, each second hole having a second flexible sheet protruding from one end and extending into the second hole, each second flexible sheet flexibly resisting against a bottom of the base portion to assist positioning the cover.

19. The earphone receiving assembly as claimed in claim 11, wherein the releasing assembly further comprises a shaft and two torsion springs coiled around the shaft; the shaft assembles the fastening member and the rotating member together; when the cover is locked within the opening, the torsion springs accumulate elastic force; and when the cover is released from being locked within the opening, the elastic force of the torsion springs drives the rotating member rotating relative to the fastening member, thus driving the cover rotating relative to the main body to be detached from the opening.

* * * * *